United States Patent [19]

Walton

[11] Patent Number: 4,854,197

[45] Date of Patent: Aug. 8, 1989

[54] TORQUE WRENCHES

[75] Inventor: John N. Walton, Whitley Bay, England

[73] Assignee: Hedley Purvis Limited, Northumberland, England

[21] Appl. No.: 145,915

[22] Filed: Jan. 20, 1988

[30] Foreign Application Priority Data

Jan. 20, 1987 [GB] United Kingdom ..... 8701194

[51] Int. Cl.[4] ..... B25B 13/46

[52] U.S. Cl. ..... 81/57.39; 81/57.44; 81/59.1

[58] Field of Search ..... 81/57.39, 57.44, 54.1, 81/57.43, 57.45, 57.13, 57.29, 57.28; 53/57, 54

[56] References Cited

U.S. PATENT DOCUMENTS

| | | | |
|---|---|---|---|
| 2,482,387 | 9/1949 | Veneman . | |
| 3,438,451 | 4/1969 | Hayes, Jr. . | |
| 3,620,105 | 11/1971 | Batten . | |
| 4,027,561 | 6/1977 | Junkers . | |
| 4,201,099 | 5/1980 | Junkers . | |
| 4,275,620 | 6/1981 | Collins . | |
| 4,336,727 | 6/1982 | Junkers | 81/57.39 |
| 4,339,968 | 7/1982 | Krieger . | |
| 4,346,630 | 8/1982 | Hanson . | |
| 4,524,651 | 6/1985 | Dubiel et al. | 81/57.44 |
| 4,669,338 | 6/1987 | Collins . | |
| 4,674,368 | 6/1987 | Surowiecki . | |
| 4,706,527 | 11/1987 | Junkers . | |
| 4,744,271 | 5/1988 | Collins | 81/57.39 |

FOREIGN PATENT DOCUMENTS

| | | |
|---|---|---|
| 2626923 | 6/1976 | Fed. Rep. of Germany . |
| 2914707 | 10/1980 | Fed. Rep. of Germany . |
| 1035176 | 4/1953 | France . |
| 244777 | 12/1925 | United Kingdom . |
| 1243927 | 8/1971 | United Kingdom . |
| 1584068 | 2/1981 | United Kingdom . |

*Primary Examiner*—Frederick R. Schmidt
*Assistant Examiner*—Maurina Rachuda
*Attorney, Agent, or Firm*—Cushman, Darby & Cushman

[57] ABSTRACT

The double-acting piston of a torque wrench has a piston rod, the free end of which receives a pin which is guided at each end in straight or curved guide channels in the wrench housing. The pin passes through drive shoes which are slidably received in slots at the upper end of a drive lever. As it reciprocates, the driver lever rotates a ratchet wheel, the ratchet wheel having a square central bore to receive a square drive shaft journaled in the housing. If the constant force is applied, the torque wrench provides a substantially constant torque, particularly if the guide channels are curved to compensate for frictional losses. The ratchet mechanism includes rollers which float between grooves in the ratchet wheel and sockets in the drive lever.

14 Claims, 8 Drawing Sheets

TORQUE WRENCHES

BACKGROUND OF THE INVENTION

This invention relates to torque wrenches used for rotating mechanical components, e.g. for tightening or loosening nuts, bolts and screws.

Generally these wrenches use a wrench head, for example a removable standard socket spanner, carried by holding means on the wrench, normally a shaft mounted rotatably in a housing. As an alternative, special sockets may be used, these sockets having a polygonal bore for the nut or other polygonal head to be rotated by the wrench and a shaft which fits into a hole in the wrench, this hole then constituting the holding means for the socket. At least one drive lever extending radially from and pivotable coaxially with the said holding means is connected to it by a ratchet, and a piston rod of a reciprocating fluid piston cylinder arrangement is pivotally connected to the drive lever or levers at a location radially spaced from the said holding means, to oscillate the lever and thus drive the said holding means in rotation through the ratchet.

Since in most known arrangement the drive lever oscillates in an arc about the axis of the said holding means, the distance between the line of action of the piston rod and the said axis varies throughout the oscillation. In theory when a constant force is applied the torque exerted on the said holding means is proportional to this distance.

U.S. Pat. No. 4,027,561 shows a torque wrench of this kind in which the hydraulic cylinder is pivoted at the end remote from the drive levers to accommodate the arcuate movement of the end of the piston rod remote from the cylinder, the piston rod itself reciprocating on the axis of the cylinder. In FIGS. 1 to 3 of United Kingdom Pat. No. 2,028,204,B the cylinder bore is formed in the housing of the wrench so that the cylinder has a fixed axis and the piston rod is swivelably mounted in the piston, again so as to accommodate the movement of the far end of the piston rod in an arc round the shaft axis.

SUMMARY OF THE INVENTION

The new scientific frontiers through which modern industry is passing demand great accuracy in predicting and providing accurate bolt loads. Equipment capable of providing this facility is now essential and would be available through exercising a substantially constant torque on the said means for holding the socket. An arrangement with this in mind is shown in FIG. 4 of UK Pat. No. 2,028,204,B above mentioned. Here the piston rod is screwed into the piston and the free end of the piston rod, which rotates the drive lever, has a pin operating in the slot in the drive lever.

An object of the present invention is to provide a hydraulic torque wrench which will exercise a substantially constant torque, while ensuring the minimum of wear at the connection between the end of the piston rod and the drive lever or levers, and avoidance of unnecessary bending stresses on the piston rod.

In order to meet this object we form a slot with parallel sides at or near the end of the drive lever, a shoe guided in the parallel sides and which can reciprocate in the slot, the remote end of the piston rod being pivotally mounted to the shoe by a pin which passes through the shoe and is guided in guide channels which are formed in the wrench body or otherwise fixed in position in relation to the wrench housing. Inevitably, there is some loss of power when the shoe is moving in the slot, with the result that the torque exerted on the means for holding the socket is not exactly proportional to the distance from the said holding means to the line of movement of the piston rod. In order to create a still more constant torque, the guide channel for the end of the pin passing through the shoe may be curved. The curve may be such that the aforesaid distance, i.e. the length of the perpendicular from the said holding means to the line of movement of the piston rod, is at a minimum at the point where friction due to movement of the mechanism is a minimum.

A torque wrench according to the invention can be readily so constructed that the drive lever and ratchet mechanism can be removed from the device by taking out a drive shaft, and we further provide a ratchet link which can be utilised with wrenches where the drive lever and ratchet mechanism can be so removed. Such a ratchet link according to the present invention comprises a member forming a lever of which one end is constructed to cooperate with and be moved by the piston rod of the fluid piston-cylinder arrangement of the wrench and the other end forms a housing for a ratchet wheel having a ratchet connection between the wheel and the said member, the said member having a bore between its ends to fit a drive shaft of the torque wrench or another shaft replacing the said drive shaft, and the ratchet wheel being constructed to fit over a nut so as to rotate the same.

A ratchet link so constructed can be used to tighten or loosen nuts which are situated so close to an obstruction in the axial direction of the nut that access is not available for a tool utilising standard sockets.

In another aspect of the invention, we seek to provide a compact and reliable ratchet for torque wrenches. In the past, these ratchets have usually comprised a pawl on the drive lever which abuts the teeth of a ratchet wheel mounted coaxially on the means for holding the socket. According to this aspect of our invention the pawl is replaced by one or more rollers, but not more than three such rollers, which float between grooves in the ratchet wheel and a socket or sockets in the drive lever. When the drive lever is executing a driving stroke the roller or rollers are located in the grooves on the ratchet wheel and are propelled by shoulders on the drive lever whereas, when the drive lever is on its return stroke, the roller or rollers move back into the socket or sockets in the drive lever. A spring may be provided for each roller to urge it towards the ratchet wheel. We are aware that rollers have been used in place of pawls in the ratchet arrangements of torque wrenches. U.S. Pat. No. 3,745,858 shows such a device in which the rollers are located at places right round the circumference of the ratchet wheel. This arrangement is however bulky, and we have found that it is quite sufficient to have one, two or three such rollers, all positioned on that side of the ratchet wheel which is towards the operating mechanism or, more precisely, opposite the hemicylindrical surface of the ratchet wheel nearest the guide channels, with a consequent improvement in size, accessibility and weight.

It is clear that the ratchet of the present invention is utilisable in the torque wrench or in the ratchet link.

BRIEF DESCRIPTION OF THE DRAWINGS

Various embodiments of the invention are shown in the accompanying drawings in which.

In all the embodiments shown similar parts are given the same reference numeral.

DESCRIPTION OF THE PREFERRED EMBODIMENTS

Figure 1:
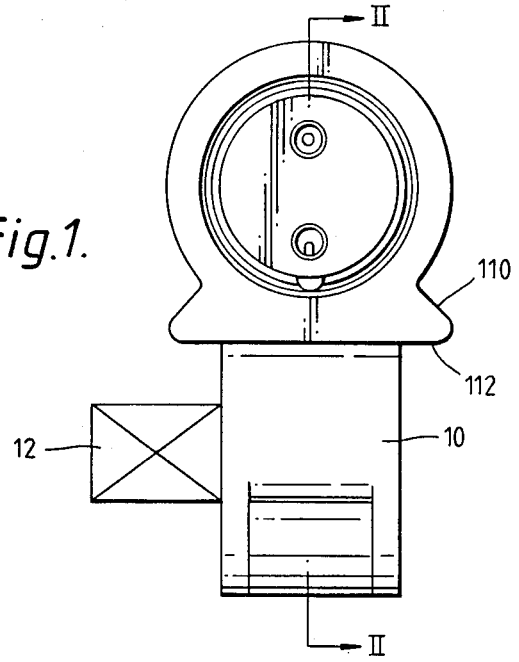
FIG. 1 is an end view of one form of torque wrench according to the invention.
Figure 2:
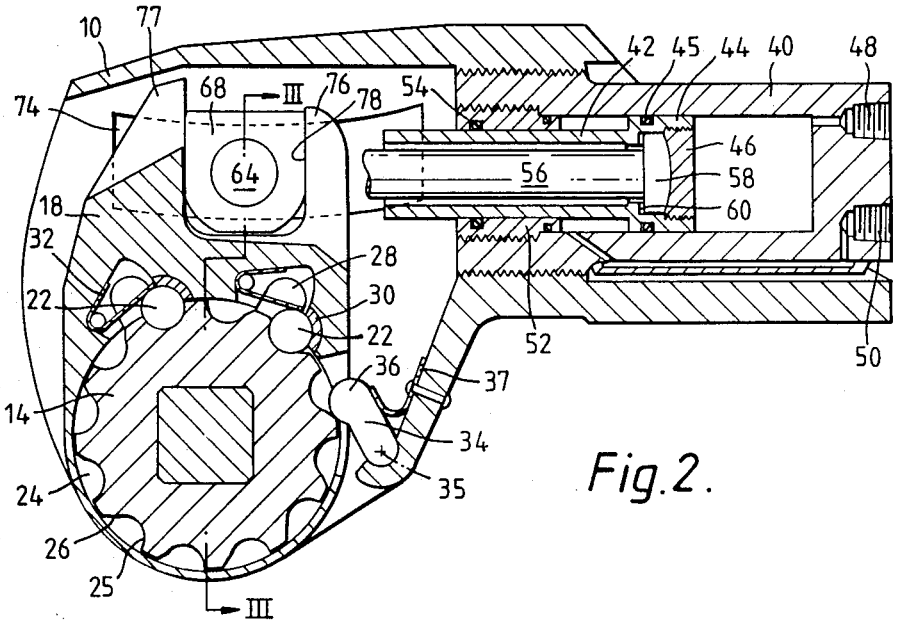
FIG. 2 is a section on the line II—II in FIG. 1.
Figure 3:
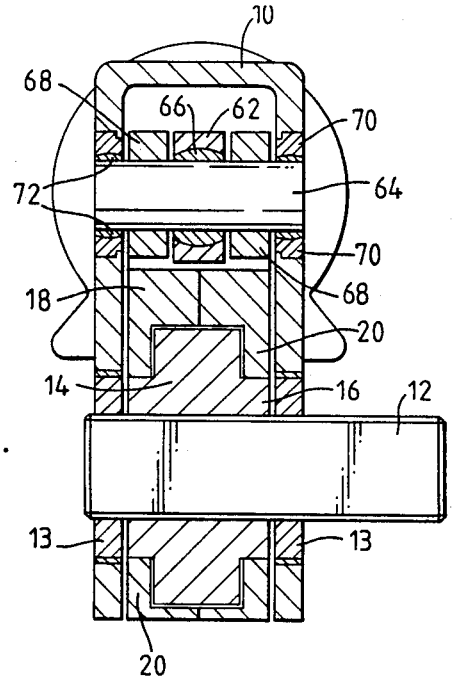
FIG. 3 is a part section on the line III—III in FIG. 2.

Referring first to FIG. 1 to 3 the torque wrench comprises a housing 10 in which a square shaft 12 is mounted for rotation by means of support bearings 13 in the housing 10. This shaft can be fitted with a removable standard socket spanner appropriate for the nut or bolt head to be turned by the device. Between the sides of the housing 10 the shaft 12 carries a ratchet wheel 14 driven in a counterclockwise direction (as viewed in FIG. 2) by a drive lever 18 which surrounds the ratchet wheel 14.

As seen in FIG. 3 the ends 16 of the ratchet wheel 14 have a smaller diameter than the centre portion, and similarly the sides 20 of the drive lever 18 extend inwardly to a greater extent than the centre part so as to be journalled on the ends 16 of the ratchet wheel 14. The sides 20 also form flanges constituting end stops for rollers 22 which constitute the driving connection between the drive lever 18 and ratchet wheel 14, replacing the pawl which is the usual driving connection to a ratchet wheel. The drive lever is made in two halves, as shown in FIG. 3, to enable it to be fitted over the ratchet wheel 14, the two halves of the drive lever being rigidly connected together after assembly by screws (not shown).

The rollers 22 float between grooves 24 found in the outer circumference of the ratchet wheel 14 and sockets 28 in the drive lever 18. On a driving stroke of the drive lever 18 each roller 22 lies between a shoe 30 located in a shoulder of the drive lever 18 and the forward end 25 of a groove 24. When, on the other hand, the drive lever 18 is performing a reverse stroke, the rollers 22 each run back up the rear end 26 of the groove 24 in which it is located and move into one of the sockets 28 in the drive lever 18. Springs 32 anchored to the drive lever 18 bias the roller 22 towards the ratchet wheel 14, so that they slip into the grooves 24 at the beginning of the next driving stroke of the drive lever 18. A holding pawl 34, pivoted to the housing 10 at 35 has the free end 36 shaped as a part-cylinder of the same diameter as that of the rollers 22. The holding pawl is biased towards the ratchet wheel 14 by a leaf spring 37, and prevents any substantial rearward movement of the ratchet wheel.

Power for the torque wrench is provided by a hydraulic cylinder 40 and double-acting piston 42, hydraulic fluid being fed and exhausted through ports 48, 50 according to the direction of movement of the piston 42. At one end the piston 42 has a head 44, which fits in the bore of the cylinder through a suitable packing such as an O-ring 45, and is provided with a cap 46 screwed into the piston head 44. The cylindrical body of the piston 42 passes through a gland 52 in the open end of the cylinder, this gland being sealed to the cylinder; a packing 54 between the gland 52 and the piston 42 forms a seal against hydraulic fluid at this point.

Figure 4:
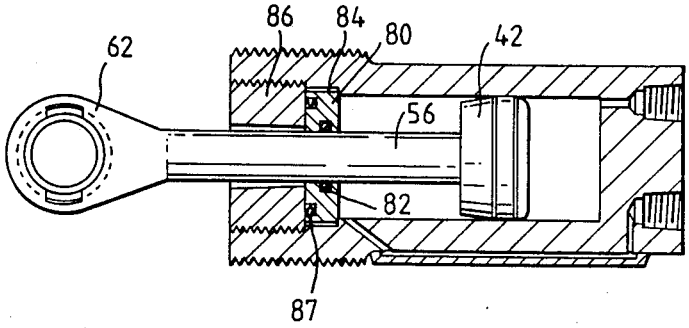
FIG. 4 shows a modification of the cylinder arrangement.

The piston 42 is hollow to accommodate a piston rod 56. At one end the piston rod 56 has a head 58 located between the piston cap 46 and a shoulder 60 in the piston head 44. The end face of the head 58 and the adjacent face of the cap 46 are spherical in shape to allow for some degree of pivoting of the piston rod 56 in all directions. The other end of the piston rod has been cut away in FIG. 2, but is the same as shown in FIG. 4, being also illustrated in section in FIG. 3. At this end the piston rod has a head 62 bored to take a pin 64 through a spherical bearing 66. The pin 64 is journalled in two drive shoes 68, one each side of the piston rod head 62, and is mounted at each end in a support shoe 70 through spherical bearings 72. The support shoes 70 can move along guide channels 74, each formed in the housing 10 or in a member secured to the housing. The guide channels are in any event stationary in relation to the housing.

At its upper end (in the position seen in FIG. 2) the drive lever 18 is bifurcated to leave upstanding ears 76,76 and 77,77, the head 62 of the piston rod 56 passing between the ears 76. Also at its upper end the drive lever 18 is formed with a parallel sided recess which is divided centrally by the ears 76 to provide a slot 78, one on each side, to form guideways for the drive shoes 68.

In operation it can be seen that the driving stroke of the piston forces the pin 64 to the left (as seen in FIG. 2) and rotates the ratchet wheel 14 counterclockwise through the drive lever 18, the rollers 22 and the ratchet wheel 14. During the return stroke the rollers 22 move into the sockets 28 in the drive lever 18, and the drive lever moves clockwise without moving the ratchet wheel 14 which is held by the holding pawl 34.

Figure 12:
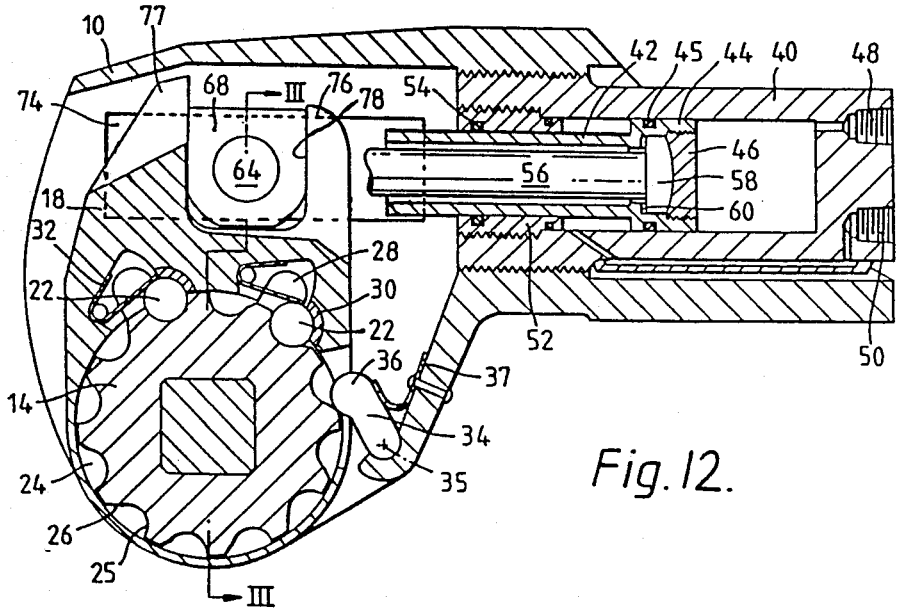
FIG. 12 is a view similar to FIG. 2 but showing a straight configuration for the guide channel.

During the reciprocation of the piston 42, head 62 of the piston rod is guided by the pin 64, the movement of which is controlled by the shape of the guide channels 74. The guide channels 74 could be straight, as shown in FIG. 12 in which case, ignoring the effect of friction, there would be a constant torque system, the movement of torque being calculated as the force exerted by the piston multiplied by the length of the normal from the centre of the ratchet wheel 14 to the straight axis of movement of the piston rod 56. However, it will be appreciated that, as the drive lever 18 rotates, the drive shoes 68 move along the slots 78, and the effect of the frictional forces between the shoes 68 and the slots 78 and between the support shoes 70 and the guide channels 74 will vary according to the position of the shoes 68 in the slots. To counter this, the guide channel 74 of the embodiments shown in the drawings other than FIG. 12 is curved so that, as the shoes 68 move up the slots 78 and the frictional force becomes greater, the normal from the centre of the ratchet wheel 14 to the axis of movement of the piston rod 56 becomes greater. In this way a still closer approximation to constant torque can be obtained over the whole stroke of the piston.

It will be seen from the above description that some up and down movement of the head 62 of the piston rod is called for when the guide channels 74 are curved. Additionally there is always some distortion of the housing 10 when the torque wrench is used. One aspect of this is the simple counter-torque on the device when a nut is tightened, this being in the plane of the drawing of FIG. 2. If this counter-torque is taken by the end of a laterally extending plate attached to the casing, so that the reaction force between the plate and the stationary object against which it is laid is not in the plane of the drawing, there is then a torque which can be resolved into a torque in the plane of the drawing, and a torque at right angles to this plane. It is to meet the distortions caused by this that the piston rod 56 is given a freedom of rotational movement in all directions and the bearings 66 and 72 are spherical bearings.

In the modification shown in FIG. 4 both the piston 42 and piston rod 56 are allowed a degree of rotational movement. To this end the piston rod 56 passes through a gland 80 with a normal seal 82 against egress of hydraulic fluid. The gland 80 is held in place between a shoulder 84 and a support ring 86, which is firmly attached to the inside of the cylinder 40, and which is bored centrally so that the piston rod 56 can pass through with sufficient clearance to allow pivotal movement of the piston rod. A face seal 87 prevents passage of fluid between the gland 80 and the support ring 86. The diameter of the gland 80 is less than that of the part of the cylinder 40 in which it is located, and it can therefore move laterally as the piston rod 56 swings out of the line of the axis of the cylinder.

Figure 5:
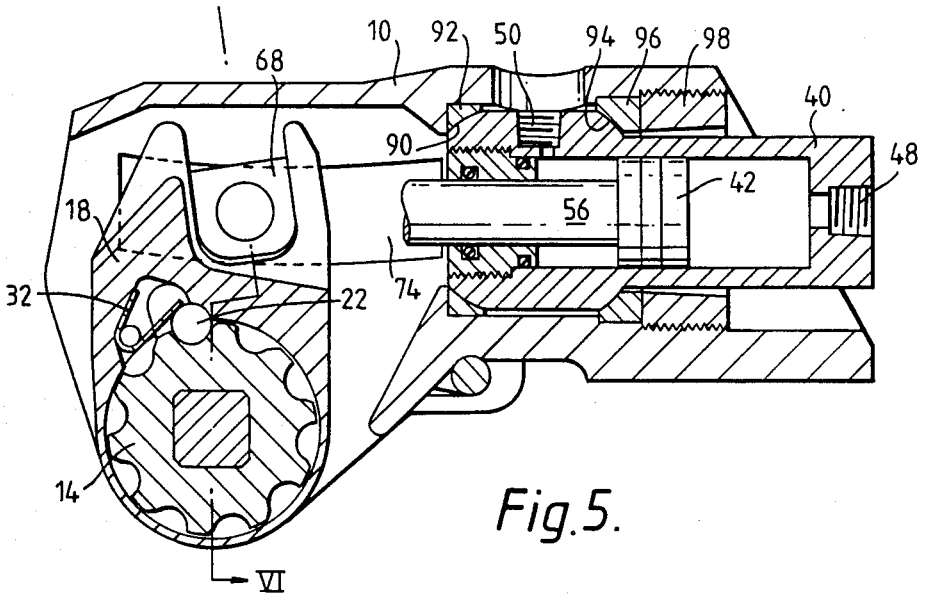
FIG. 5 is a longitudinal section through another embodiment, taken on the line V—V in FIG. 6.
Figure 6:
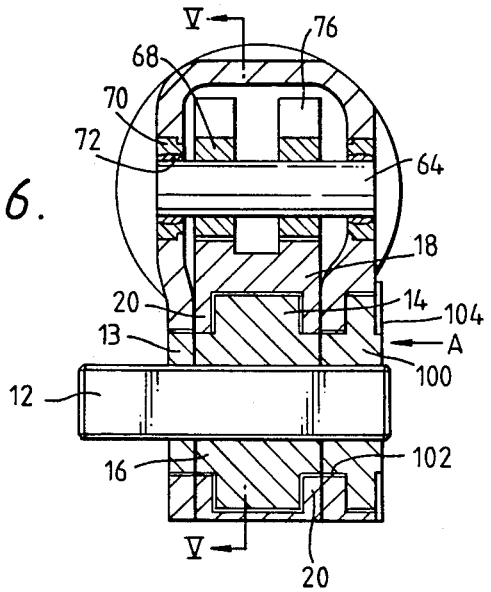
FIG. 6 is a section on the line VI—VI in FIG. 5.
Figure 7:
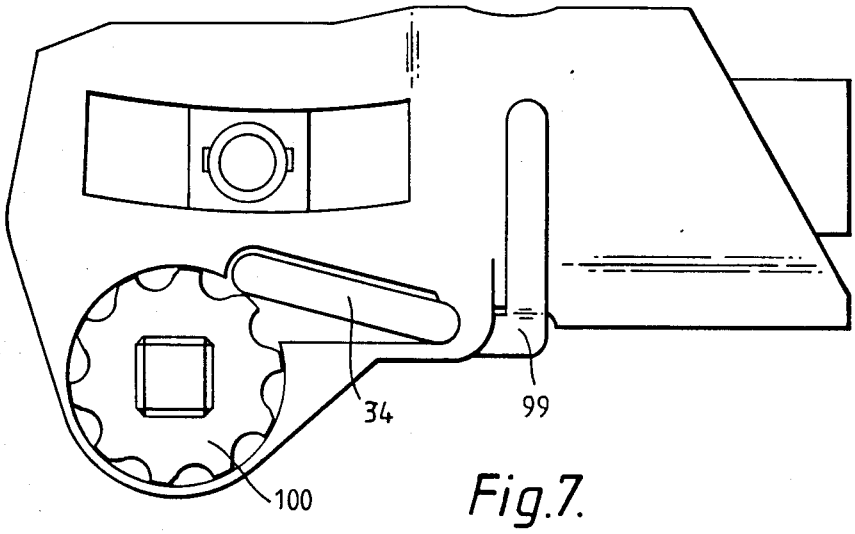
FIG. 7 is a view in the direction of the arrow 'A' in FIG. 6 with the cover plate removed.

The mode of operation of the embodiment shown in FIGS. 5 to 7 is similar to that of FIGS. 1 to 3, and only the differences in design need be explained. In this embodiment the front end of the cylinder 40 has a part spherical surface 90 which abuts a complementarily shaped bearing 92, being held there by a part spherical thrust bearing 96 which abuts a complementarily shaped shoulder 94 on the cylinder, the thrust bearing 96 being held in place by a thrust collar 98. In this embodiment the piston rod 56 always moves along the axis of the cylinder 40 and it is the cylinder which rotates as necessary according to the movement of the head 62 of the piston rod, sufficient space being allowed for this between the cylinder 40 and the thrust bearing 96 and thrust collar 98.

In this embodiment there is only one roller 22, but otherwise the actuation of the ratchet wheel 14 is the same as with the embodiment of FIGS. 1 to 3. Moreover, the holding pawl 34 does not operate on the ratchet wheel 14 but on a similarly shaped wheel 100 fixed on the drive shaft 12 beside the ratchet wheel 14. The wheel 100 is journalled in the housing 10 at 102 and in effect acts also as a support bearing for the shaft 12 opposite the support bearing 13. A release lever 99 allows the holding pawl 34 to be disengaged when this is desired. The holding pawl 34 and the grooves in the wheel are protected by a cover plate 104.

Figure 8:
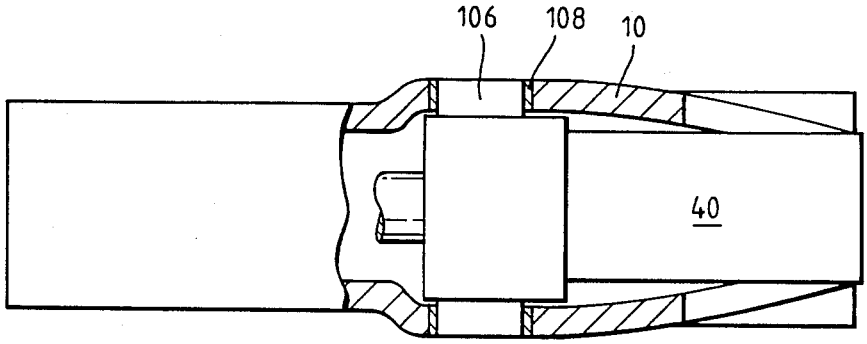
FIG. 8 shows a modification of the cylinder mounting.

The modification shown in FIG. 8 shows a different cylinder mounting. Here the cylinder 40 is mounted with projections 106 on each side journalled in bearings 108 in the housing 10 so that the cylinder 40 can move at right angles to the plane of the figure, i.e. in the plane of FIG. 5. Otherwise the modification is the same as that of FIGS. 5 to 7.

In all the embodiments the drive shaft 12 can be pushed through from one side to the other so that nuts and bolts may be both tightened and unscrewed.

In all the forms of the torque wrench shown in the drawings, the end of the casing 10 which lies adjacent the hydraulic cylinder 40 is provided with ears 110 leading to a flat lower surface 112, a construction which allows ancillary fitments to be slid onto the housing. One such ancillary fitment can be a laterally extending plate as referred to above.

Figure 9:
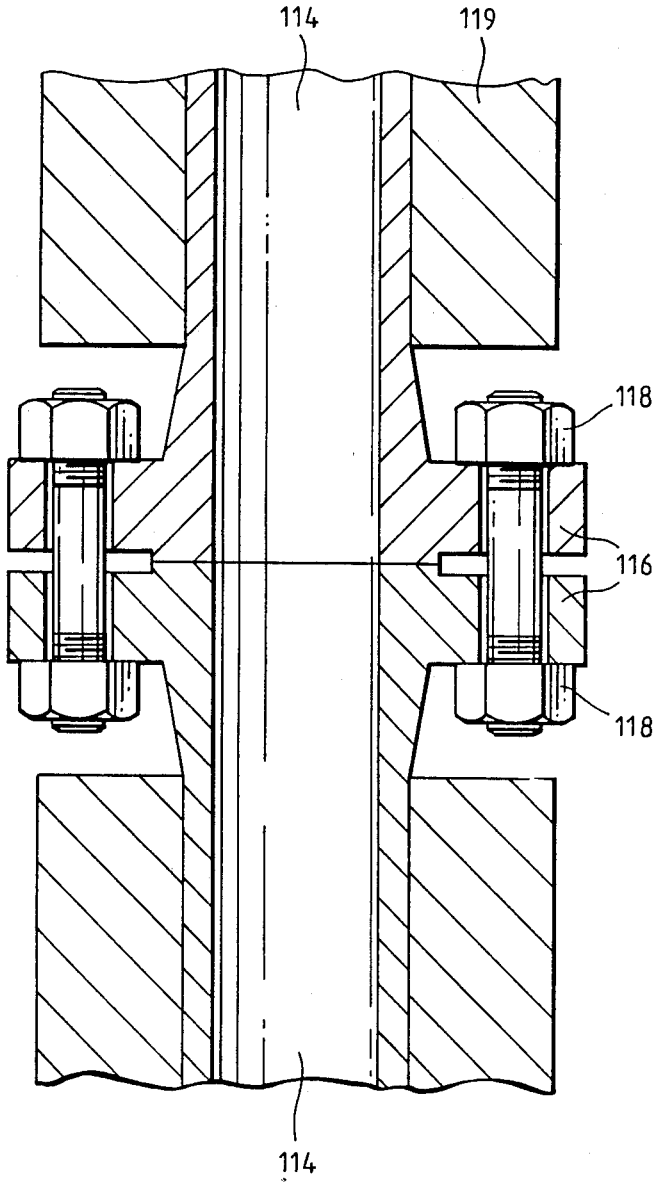
FIG 9 illustrates a situation where a conventional torque wrench cannot be used.

The design of torque wrench which we have described and illustrated in FIGS. 1 to 8 has allowed us to evolve a useful accessory in the form of a ratchet link for specialised flange use in those cases where the conventional torque wrench cannot be employed. An example of such a case is shown in FIG. 9 which illustrates two sections of pipe 114, each having a circular flange 116 at the end connected through a threaded bolt and nuts 118. Cladded insulation 119 prevents the torque wrench and socket spanner being used and another tool must be employed. Specialised hydraulic tools have been evolved for this purpose, and it is also known to adapt normal hydraulic wrenches by fitting a roller attachment and a torque link. However, in this latter case, the ratchet mechanism built into the machine cannot be used and as a result the tool has to be manually repositioned after each forward stroke of the piston, which is time consuming and tiring for the operator.

According to a further aspect of the present invention we provide a ratchet link which can be utilized with a hydraulic wrench which is so constructed that the drive lever and ratchet mechanism can be removed from the device by taking out the drive shaft. It can readily be seen from the above description that this applies to the torque wrench illustrated in FIGS. 1 to 8.

Figure 10:
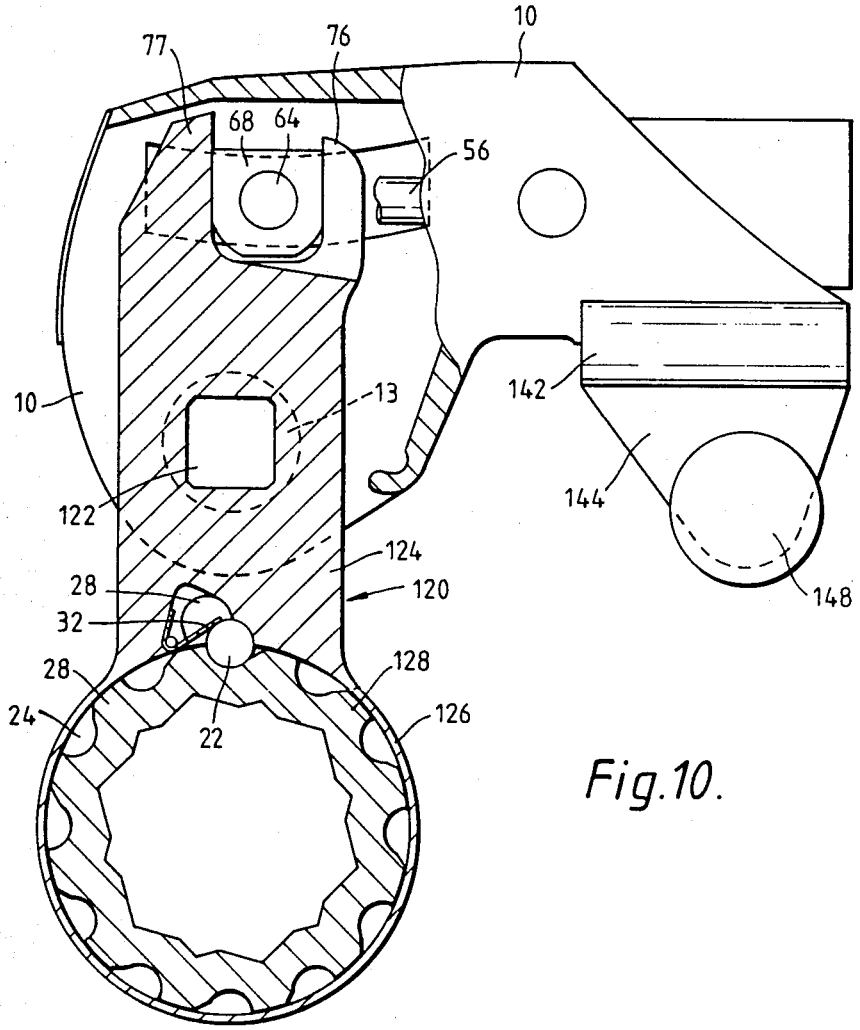
FIG. 10 is a side view, partly sectioned, of a torque wrench as illustrated in any one of FIGS. 1 to 8, in which the drive lever and ratchet mechanism have been removed and replaced by one embodiment of ratchet link according to the invention, and a roller attachment has been added.
Figure 11:
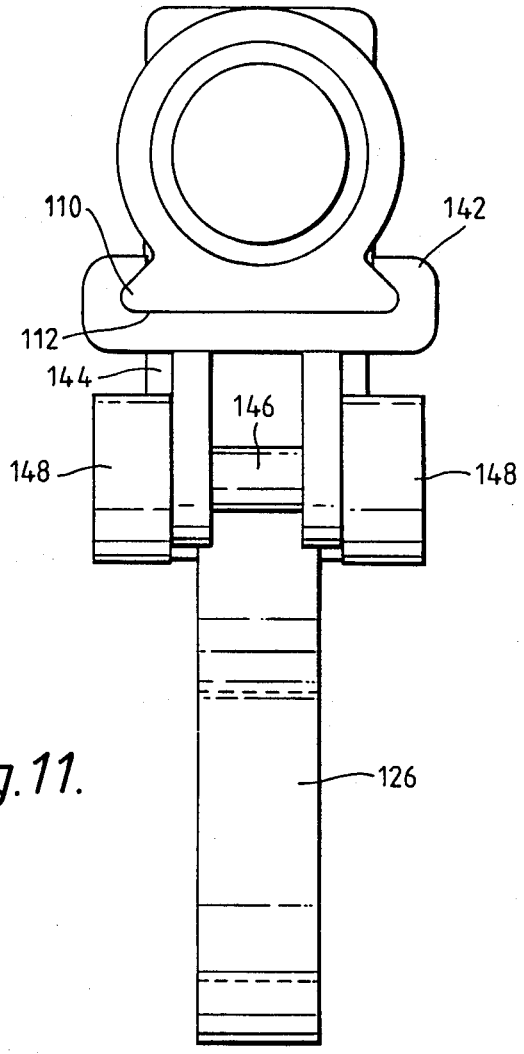
FIG. 11 is an end view of FIG. 10.

Reference may now be made to FIGS. 10 and 11 of the drawings. The reference numeral 10 in FIG. 10 designates the housing of any of the torque wrenches described by reference to FIGS. 1 to 8. As can be seen in FIG. 10 the drive lever 18 and the ratchet wheel 14, together with the parts thereon, have been removed as a unit after withdrawing the drive shaft 12 and this unit has been replaced by the ratchet link generally designated at 120, this being held in place by reinserting the drive shaft 12 in its normal position in the torque wrench, but on this occasion passing it also through the hole 122, thus retaining the upper part of the ratchet link 120 between the sides of the housing 10. In this position, the upper end of the ratchet link 120 (in the position seen in the drawings) fits over the drive shoes 68, being formed with upstanding ears 76,77 for this purpose. It can be seen that the body 124 of the ratchet link 120 acts as a lever which pivots round the drive shaft 12.

At its lower end the body 124 of the ratchet link 120 forms a housing 126 for a ratchet wheel 128, the connection between the ratchet wheel and the body 124 being a roller 22 which floats between grooves 24 in the ratchet wheel and a socket 28 in the body 124 in the same manner as is noted above in reference to FIG. 5. A spring 32 exercises the same function as the spring 32 in FIG. 5.

The end of the housing 10 adjacent the cylinder is fitted with a roller or pad attachment, a roller attachment being shown in FIGS. 10 and 11. This comprises a sleeve 142 which can be slid over the ears 110 of the torque wrench. Depending members 144 attached to the sleeve 142 are bored to receive an axle 146 carrying the rollers 148.

The ratchet wheel 128 is suitably bored to accommodate nuts of the correct size to be tightened or loosened. The piston rod 56 is reciprocated in the usual way. Forward movement of the piston rod causes the ratchet link 120 to pivot round the drive shaft 12 and the roller 22 to engage with a groove 24 in the ratchet wheel, thus turning the nut. On the return stroke of the piston rod 56 the drive roller 22 moves into the socket 28 and thus into an adjacent groove 24 on the ratchet wheel 128.

On every forward movement of the piston rod 56 the housing 10 will try to rotate in the opposite direction to the nut. This is prevented by the reaction roller 148 which rests against the periphery of the flange (for example the flange 116 shown in FIG. 9). At the same time the whole apparatus is pulled forward as the ratchet link rotates about the axis of the nut 118.

I claim:

1. A torque wrench comprising a housing, means rotatable in the housing for holding an exchangeable socket for a polygonal member to be rotated by the wrench, a drive lever extending radially and pivotable coaxially with the said holding means, a ratchet connection between the drive lever and the said holding means and a reciprocating fluid piston-cylinder arrangement having a piston rod which actuates the drive lever wherein a slot with parallel sides is formed in the drive lever at or near the end remote from the said holding means, a shoe is located in the slot to be guided by the parallel sides of the slot, and the end of the piston rod is pivotally mounted to the shoe by a pin which passes through the shoe and is guided at each end in guide channels which are fixed in position in relation to the wrench housing.

2. A torque wrench according to claim 1 having two said shoes, one on each side of the centre line of the piston rod, each shoe being located between the parallel sides of a slot in the drive lever.

3. A torque wrench according to claim 1, wherein the guide channels are straight.

4. A torque wrench according to claim 1, wherein the guide channels are curved in such a way as to provide a more constant torque over the effective stroke of the piston.

5. A torque wrench according to claim 1, wherein the cylinder is fixed relative to the torque wrench housing and the piston rod is allowed a small pivotal movement relative to the cylinder axis.

6. A torque wrench according to claim 1, wherein the cylinder is pivotally mounted, the piston rod being constrained to move along the axis of the cylinder.

7. A torque wrench according to claim 6, wherein the cylinder is mounted on a cylindrical bearing to allow a small movement of the front end of the cylinder in all directions.

8. A torque wrench according to claim 1, wherein the ratchet connection comprises at least one roller which floats between grooves in a ratchet wheel and a socket in the drive lever, the roller and socket being located at that side of the hemi-cylindrical surface of the ratchet wheel which in nearest the guide channels.

9. A torque wrench according to claim 8, wherein a holding pawl is located to prevent any substantial reverse movement of the ratchet wheel, the end of the holding pawl being shaped with a part-cylindrical face to fit the grooves in the ratchet wheel, or a separate grooved wheel on the shaft.

10. A torque wrench according to claim 8, wherein the sides of the drive lever are extended to form flanges on each side of the grooves in the ratchet wheel in order to constitute end stops for the roller or rollers.

11. A torque wrench according to claim 10, wherein the said flanges are journalled on the ratchet wheel.

12. A ratchet link utilisable with a torque wrench having a drive lever mounted on a drive shaft, a fluid piston-cylinder arrangement having a piston rod to operate the drive lever and ratchet mechanism between the drive lever and drive shaft, and which is constructed so that the drive lever and ratchet mechanism are removable from the wrench by taking out the drive shaft, the ratchet link comprising a member forming a lever of which one end is constructed to cooperate with and be moved by the piston rod of the fluid piston-cylinder arrangement of the wrench and the other end forms a housing for a ratchet wheel having a ratchet connection between the wheel and the said member, the said member having a bore between its ends to fit the drive shaft of the torque wrench or another shaft replacing the said drive shaft, and the ratchet wheel being constructed to fit over a nut so as to rotate the same.

13. A ratchet link according to claim 12 wherein the ratchet connection comprises at least one roller which floats between grooves in the ratchet wheel and socket in the said member, the roller and socket in being located at the side of the hemicylindrical surface of the ratchet wheel which is nearest the said bore.

14. In combination a torque wrench so constructed that the drive lever and ratchet mechanism are removable from the wrench by taking out the drive shaft, a ratchet link according to claim 12, reaction roller removably attachable to the casing of the wrench.

* * * * *